US006552285B1

(12) United States Patent
Sears et al.

(10) Patent No.: US 6,552,285 B1
(45) Date of Patent: Apr. 22, 2003

(54) MOUNT FOR DISC SWITCH

(75) Inventors: Merle Dana Sears, Mooresville, IN (US); William Bruce Sutherlin, Indianapolis, IN (US); Hall Virgil, Brownsburg, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/090,583

(22) Filed: Mar. 4, 2002

(51) Int. Cl.[7] ..... H01H 9/02
(52) U.S. Cl. ..... 200/294; 200/295; 200/296
(58) Field of Search ..... 200/294–296; 248/27.1, 27.3; 174/5.21–64, 66, 67, 58

*Primary Examiner*—Elvin Enad
*Assistant Examiner*—Lisa N Klaus

(74) *Attorney, Agent, or Firm*—Wall Marjama & Bilinski LLP

(57) ABSTRACT

A mount for a disc-type switch having a body that is centered upon a mounting flange. The mount includes a substrate having a central opening that permits the switch and mounting flange to be inserted into the opening. The substrate has a depression formed therein on one side of the opening that complements the shape of the flange and has a size that will accept about one half of the flange therein when the switch is passed into the opening and the flange rotated. At this time the other half of the flange is brought into contact with the top surface of the substrate. A threaded fastener secures the flange to the substrate so that at least one half of the flange is supported by the substrate to resist the downwardly directed forces acting upon the switch and the other half of the flange is supported in the housing to resist upwardly directed forces upon the switch.

9 Claims, 2 Drawing Sheets

MOUNT FOR DISC SWITCH

FIELD OF THE INVENTION

This invention relates generally to a mount for a disc-type switch and, specifically, to a mount for a flame rollout switch of the type used in a gas fired furnace to shut down the furnace in the event an over-temperature condition is sensed.

BACKGROUND OF THE INVENTION

In many gas fired furnaces, a temperature sensitive disc-type flame rollout switch is employed to detect when the furnace flue system or combustion air supply becomes clogged to a point wherein a flame rollout could pose a dangerous situation. The flame rollout switch is mounted upon the furnace in a location where flames might occur in the event that the flue system or the combustion air supply becomes blocked. This, in turn, causes a rise in the switch temperature which opens the switch thereby shutting down the furnace.

Disc type switches are generally supplied by the various manufacturers with a mounting flange that surrounds the body of the switch. In order to minimize the costs, the switch flange is usually fabricated of a thin metal plate that can be easily deformed or bent. A hole is generally provided in the substrate upon which the switch is located so that the body of the switch can pass into or through the substrate thus placing the mounting flange in seating contact against the top surface of the substrate. In some applications, screws are used to secure the flange to the substrate. In other applications, the toe end of the flange is captured in a pocket and the opposite end of the flange is secured to the substrate using a single screw.

Lead connectors are used to couple the electrical lead to the switch terminals. To ensure the reliability of the connection, the connectors must meet certain industry standards involving the amount of force required to unplug the connector from the terminal. This pull-out force is high enough to damage the mounting flange and thus require replacement of the switch.

SUMMARY OF THE INVENTION

It is a primary object of the present invention to improve apparatus for mounting disc-type switches upon a flat substrate.

It is a further object of the present invention to protect a disc-type switch from damage during periods of maintenance or the like requiring the removal of the lead connectors from the switch terminals.

A still further object of the present invention is to provide an improved mounting arrangement for a disc-type switch.

Another object of the present invention is to more securely support the mounting flange of a disc-type switch in assembly.

These and other objects of the present invention are attained by apparatus for securing a disc-type switch to a substrate. Typically, the switch has a body that is centered in a flange having a first half section that is symmetrical with a second half section. The switch body extends upwardly from the top surface of the flange and downwardly from the bottom surface of the flange. The substrate contains a hole for receiving the body of the switch and a slot that is aligned along a reference line that passes through the center of the hole and which extends to either side of the hole a sufficient distance to permit the flange to be passed through the substrate. A depression is formed in the substrate on one side of the reference line that is capable of housing one half section of the flange. In assembly, the switch body and the flange are passed through the substrate and turned to bring the one half section into the depression and the other half section into seating contact against the top surface of the substrate. A fastener is used to secure the other half section to the substrate thus locking the switch to the substrate.

BRIEF DESCRIPTION OF THE DRAWING

For a further understanding of these and other objects of the present invention, reference will be made to the following detailed description of the invention which is to be read in connection with the accompanying drawing, wherein.

DETAILED DESCRIPTION OF THE INVENTION

Figure 1:
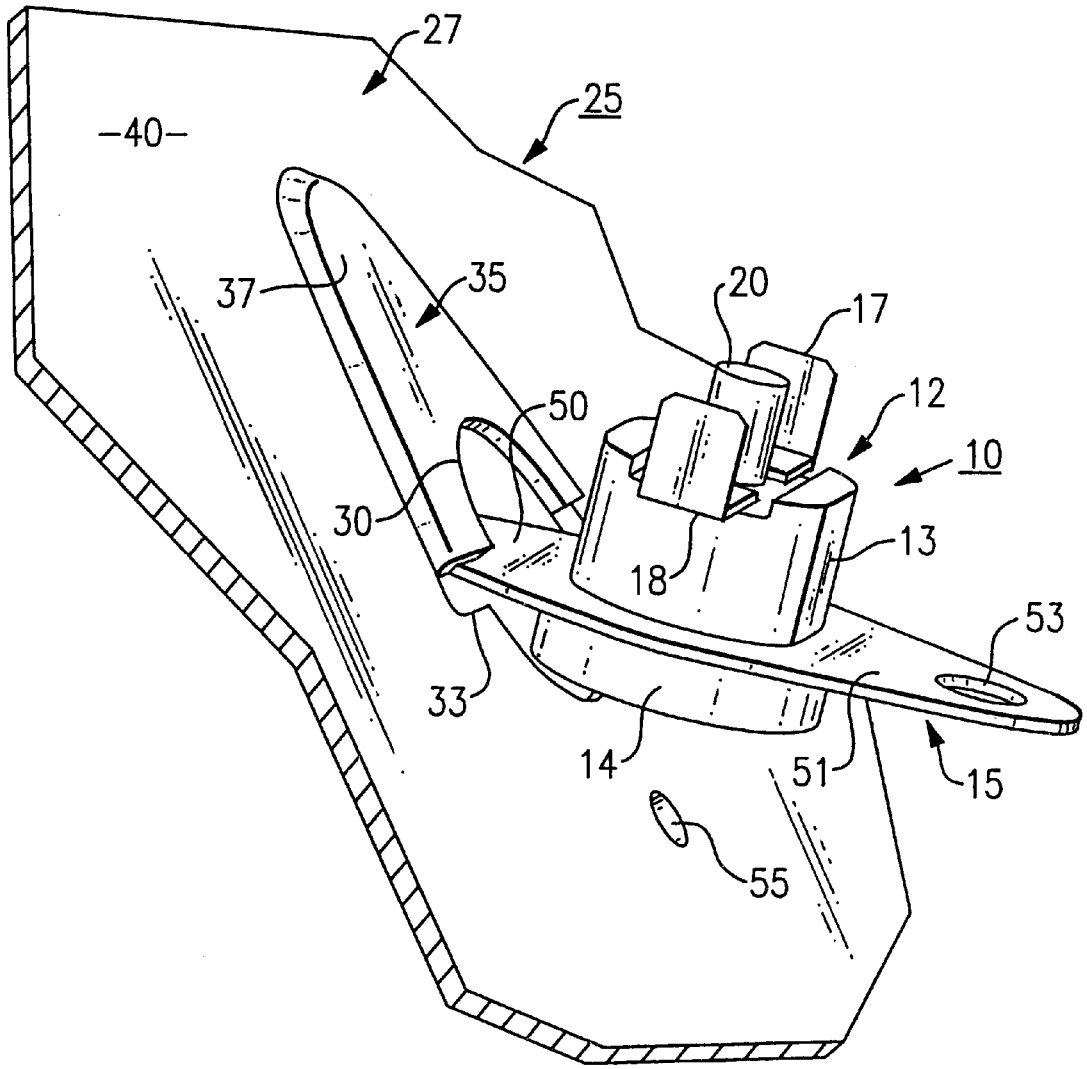
FIG. 1 is a perspective view illustrating a disc-type switch being inserted in a supporting substrate embodying the teachings of the present invention.

Turning now to the drawings, there is shown a typical disc switch, generally referenced 10, of the type employed in many gas fired furnaces to sense a flame rollout condition within the furnace. Flame rollout switches for use in gas-fired forced air furnaces of this type are commercially available through Therm-O-Disc, Inc. and Texas Instruments, Inc. The switches are normally closed and the contacts are arranged to open when the surrounding temperature rises to a preselected level.

The switch 10 contains an enclosed body 12 having an upper section 13 and a radially expanded lower section 14. The body is centered upon an oval-shaped mounting flange 15 which is secured to the body so that the upper section of the body protrudes above the top surface of the flange and the expanded lower section protrudes below the bottom surface of the flange. A pair of upraised terminals 17 and 18 are mounted upon the top wall of the switch which are arranged to coact with lead connectors (not shown). A reset button 20 may be mounted in the top of the switch body between the two terminals.

The terminals are designed to receive compatible lead connectors which are designed for a low insertion force and a high removal force so that the connectors cannot be easily dislodged once assembled. Removal of the connectors oftentimes requires a high upwardly directed force to break the bond holding the connector to the terminal. In the event that the flange is simply connected to the substrate at local points by screws or the like, the flange can be easily bent or otherwise damaged during the removal of the connectors. As will be explained in further detail below, the switch mount of the present invention is specially designed so that the switch flange is ½ upward supported ½ downward supported in assembly to protect the switch any time the switch lead must be disconnected during periodic maintenance or the like or reconnected after the maintenance is completed.

Figure 4:
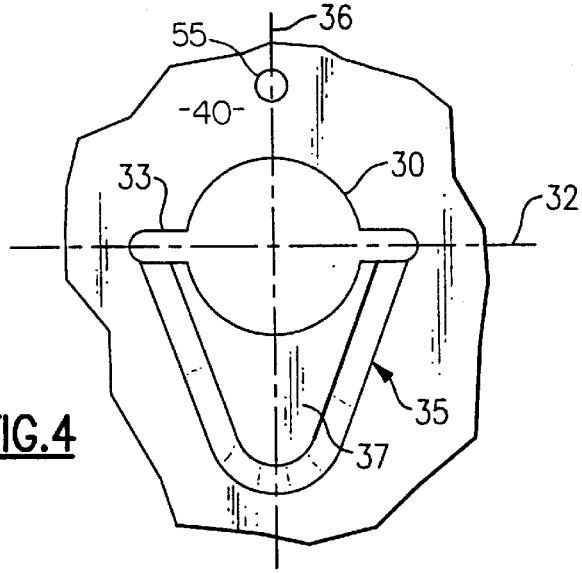
FIG. 4 is a top view of the substrate with the switch removed.

The switch mount 25 of the present invention includes a substrate 27 that is fabricated from a metal sheet, although the substrate can also be fabricated from a molded plastic or any other suitable material capable of supporting the switch flange as the lead connectors are being connected. As best illustrated in FIG. 4, a hole 30 is formed in the substrate which is centered upon a reference line 32 that is a diameter of the hole 30 and thus passes through the center of the hole. The hole has a diameter that is sufficiently large enough to permit the lower section of the switch to pass therethrough but insufficient to permit the switch flange to pass. An elongated slot 33 is aligned along the reference line 32. The slot extends an equal distance from the periphery of the hole to either side of the hole and thus permits the flange to pass through the hole when the switch is tilted at an angle as illustrated in FIG. 1.

The substrate on one side of the reference line 32 is deformed to establish a raised housing 35 having an open bottom that compliments the shape of one of the flange half sections. The housing is centered upon a second diameter 36 of the hole which is perpendicularly aligned with the reference line 32. The roof 37 of the housing is raised a distance above the top surface 40 of the substrate to a height that is about equal to the thickness of the switch flange. A threaded or punched hole 55 is formed in the substrate and is centered along the diameter 36 opposite the housing.

Figure 2:
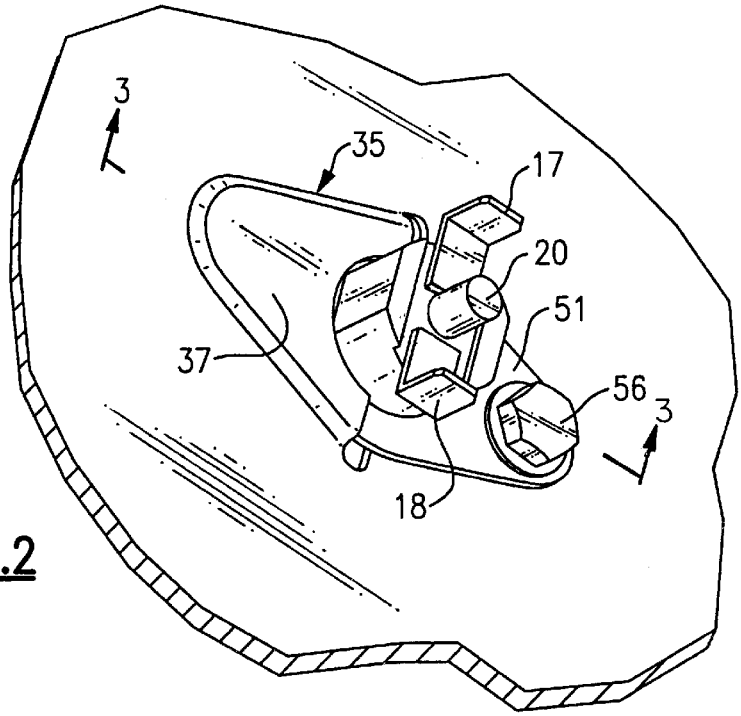
FIG. 2 is a perspective view illustrating the switch seated within the substrate.
Figure 3:
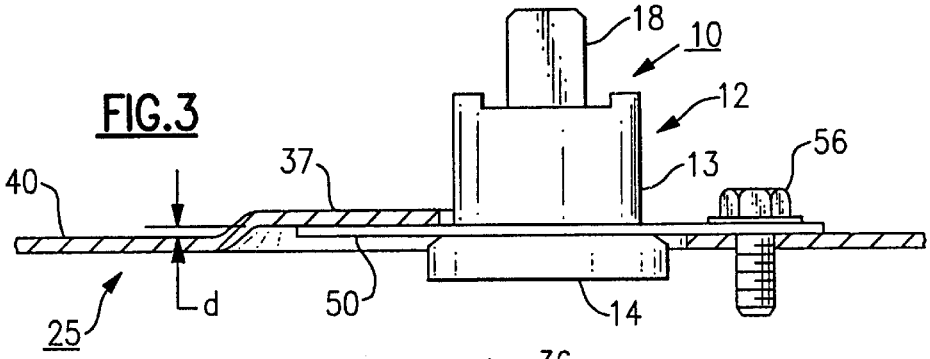
FIG. 3 is a section taken along lines 3—3 in FIG. 2.

As best illustrated in FIGS. 1 and 2, the switch 10 is mounted in the substrate by tilting the switch flange at about a 45° angle with regard to the top surface 40 of the substrate and inserting the flange into the slot 33 a sufficient distance so that the lower section of the switch body can pass through the hole 30. The switch is then rotated clockwise to bring a first half section 50 of the flange into seating contact against the roof of the housing 35. At this time, the second half section 51 of the flange is seated in arresting contact with the top surface 40 of the substrate as illustrated in FIG. 3. A clearance hole 53 is provided in the second half section of the flange which aligns with the threaded or punched hole 55 that is formed in the substrate when the second half section is seated upon the top surface of the substrate. A screw 56 is passed through the clearance hole and is threaded into hole 55 to hold the switch securely against the substrate.

As should be evident, with the switch secured to the substrate, about one half of the flange is locked in place against the roof of the substrate housing and the other half of the flange is locked in place against the top surface of the substrate. Although the switch flange may be fabricated of a relatively weak material, the substrate provides sufficient additional support to the flange to prevent the flange and thus the switch from becoming damaged when the lead connectors are removed or replaced upon the switch terminals.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. Apparatus for securing a disc-type switch having a body that is centered upon a flat flange that has a first half section and a second half section symmetrically located about the center of the switch body, said body protruding upwardly from a top surface of the flange and downwardly from the bottom surface of said flange, wherein said apparatus further includes:

a flat substrate having a hole that passes through the substrate, said hole having a size and shape such that said switch body can pass through said hole;

said substrate having a slotted opening formed therein that is aligned along a reference line that passes through the center of said hole, said slot extending outwardly to either side of said hole a sufficient distance such that said flange can pass through said slotted opening;

a depression formed in said substrate on one side of said reference line, said depression having a bottom opening that complements the shape of said first half section, the distance between the top surface of the substrate and inside surface of the depression being about equal to the thickness of said flange whereby the first half section of the flange is passed through said slotted opening and rotated into contact with the inside surface of the depression and the second half section of said flange, at the same time, brought into contact with the top surface of said substrate;

fastening means for securing said second half section of the flange in contact against the top surface of the substrate.

2. The apparatus of claim 1 wherein said flange is oval-shaped and surrounds the body of the switch.

3. The apparatus of claim 1 wherein the substrate is fabricated from a metal.

4. The apparatus of claim 1 wherein the substrate is molded from plastic.

5. The apparatus of claim 1 wherein fastening means is a screw that is threaded into said substrate.

6. A mount for a disc switch that has a body centered upon a flange so that a first section and a second section of the flange are symmetrically located on either side of the switch body, said mount further including:

a substrate having a centrally located hole passing therethrough for permitting the flange and body section of the switch to be passed into said opening;

a housing mounted upon the top surface of said substrate, said housing having a flat roof and a bottom opening that passes through said substrate whereby one half section of the switch flange is inserted through said hole and rotated into the housing and into contact with the roof of said housing and the other half section of the flange, at the same time, rotated into contact with the top surface of the substrate; and fastening means for securing said other half section to the substrate.

7. The mount of claim 6 wherein the housing is integral with the substrate.

8. The mount of claim 7 wherein the substrate and housing are molded from a high strength plastic.

9. The mount of claim 6 wherein the fastening means is a screw that is threaded into said substrate.

* * * * *